US009321569B2

(12) United States Patent
Hodge

(10) Patent No.: US 9,321,569 B2
(45) Date of Patent: Apr. 26, 2016

(54) LID AND CLOSURE MEMBER ASSEMBLY

(71) Applicant: Huhtamaki, Inc., De Soto, KS (US)

(72) Inventor: Don Hodge, Clare, MI (US)

(73) Assignee: HUHTAMAKI, INC., De Soto, KS (US)

( * ) Notice: Subject to any disclaimer, the term of this patent is extended or adjusted under 35 U.S.C. 154(b) by 0 days.

(21) Appl. No.: 14/311,555

(22) Filed: Jun. 23, 2014

(65) Prior Publication Data

US 2014/0299599 A1 Oct. 9, 2014

Related U.S. Application Data

(62) Division of application No. 13/661,634, filed on Oct. 26, 2012.

(51) Int. Cl.

| | |
|---|---|
| ***B65D 51/18*** | (2006.01) |
| ***B65D 43/02*** | (2006.01) |
| ***B65D 47/28*** | (2006.01) |
| ***B65D 41/62*** | (2006.01) |

(52) U.S. Cl.

CPC ..... *B65D 51/18* (2013.01); *B65D 41/62* (2013.01); *B65D 43/0212* (2013.01); *B65D 47/286* (2013.01); *B65D 2543/00046* (2013.01); *B65D 2543/00092* (2013.01); *B65D 2543/00296* (2013.01); *B65D 2543/00527* (2013.01); *B65D 2543/00537* (2013.01); *B65D 2543/00731* (2013.01); *B65D 2543/00796* (2013.01)

(58) Field of Classification Search

CPC ..... A47G 19/2272; B65D 2543/00046; B65D 47/286

USPC ..... 220/212, 254.1, 254.9, 255, 259.5, 328, 220/345.1–345.6, 559, 810–812; 222/561

See application file for complete search history.

(56) References Cited

U.S. PATENT DOCUMENTS

| | | | | |
|---|---|---|---|---|
| 3,247,998 | A * | 4/1966 | Tantlinger | 220/834 |
| 4,478,346 | A * | 10/1984 | Spong | 220/711 |
| 5,709,309 | A * | 1/1998 | Gallagher et al. | 220/229 |
| 6,786,521 | B1 * | 9/2004 | Jaffke et al. | 296/1.06 |
| 7,114,632 | B2 * | 10/2006 | Kraus | 220/802 |
| 7,197,831 | B2 * | 4/2007 | Nepil | 33/414 |
| 2008/0105696 | A1 * | 5/2008 | Dart et al. | 220/711 |

* cited by examiner

*Primary Examiner* — Anthony Stashick
*Assistant Examiner* — Kaushikkumar Desai
(74) *Attorney, Agent, or Firm* — Husch Blackwell LLP

(57) ABSTRACT

A lid and closure member assembly for placement on a container is provided. The lid includes a cover portion, an access port and an elongated channel defined in the cover portion. The channel may include two opposing side walls, two opposing end walls and a bottom. The channel's side walls can each include an inwardly-projecting lip forming an undercut for slidably receiving a portion of the closure member. The closure member includes an access port cap, a retainer slidably received within the channel and a strap extending between the access port cap and the retainer. The closure member is selectively movable between open and closed positions. The access port cap may cover the access port when the retainer is in a first position within the channel or may be at least partially received within the channel when the retainer is in a second position within the channel.

17 Claims, 9 Drawing Sheets

LID AND CLOSURE MEMBER ASSEMBLY

CROSS-REFERENCE TO RELATED APPLICATIONS

This application is a Divisional of and claims priority to U.S. application Ser. No. 13/661,634 filed Oct. 26, 2012 to Don Hodge entitled "Lid and Closure Member Assembly," currently pending, the entire disclosure of which is hereby incorporated by reference.

BACKGROUND OF THE INVENTION

It is very common in today's society for consumers to obtain beverages, such as coffee, tea, a soft drink, milk or juice, from fast food restaurants and convenience stores in relatively large quantities. These beverages are placed into large cups and are generally not consumed entirely in a single sitting. Rather, it is common for such beverages to be consumed over a duration of time. Often, such beverages are obtained while traveling and will be consumed in a car. Thus, it is desirable these beverages to be covered for a number of reasons, including preventing spillage.

Cups and cuplike containers beverages are often provided with lids to cover the contents before and during use. Such lids normally snap over the open end of the cup and are disposable after use. Consumers often prefer to access the contents within the cup with minimal disruption to the lid. Therefore, such lids often include openable access closures. Such access closures often include a perforated tab near the peripheral region of the lid that may be hinged back or removed entirely to provide access to the contents within the container. Such lids require that the apron of the lid, which defines its periphery, be torn back to reveal the opening. Once the periphery of the lid is broken, its engagement to the cup is much less secure. Additionally, once torn away and folded back, such tabs generally do not adequately seal the opening in order to prevent spillage when the cup is incidentally tipped or jarred.

It is also desirable for the user to have intermittent access to the beverage, which can involve the opening and closing of the lid or a portion thereof. Because the quantity of beverage may be consumed over a duration of time, it is further desirable to have a re-closable lid having a closure mechanism that will not become detached therefrom and misplaced while a part of the beverage remains in the container.

Thus, a need exists for a lid having a closure member that may be opened without requiring the lid's periphery to be broken. A need also exists for a lid and closure member assembly adapted for providing convenient access to the contents within the cup. Finally, a need exists for a lid having a closure member attached thereto such that the closure member will not become removed or misplaced over a period of time.

SUMMARY OF THE INVENTION

The present invention involves the provision of a lid and closure member assembly for placement on a container. The lid includes a cover portion, an access port or hole for providing access to contents within the container and an elongated channel defined in the cover portion. The channel may be racetrack-shaped, and defined by two opposing generally parallel side walls and two opposing curved, semicircular end walls. The channel also includes a bottom wall. One or more of the side walls and end walls include an inwardly-projecting lip extending therefrom into the channel thereby forming a groove or undercut defined between the lips and the channel's bottom wall for slidably receiving a portion of the closure member. In one embodiment, the channel has a generally c-shaped cross-section formed by the bottom wall, the side walls and the lips.

The closure member includes an access port cap, which may be in the form of a plug, for selectively covering the lid's access port, a retainer slidably received within the channel and a strap extending between the access port cap and the retainer. The closure member is selectively movable between open and closed positions. In one embodiment, the retainer includes an at least partially annular retaining bead positioned and maintained below the channel's inwardly extending lips. In this embodiment, the horizontal distance between the lips is less than the diameter of the retaining bead in order to maintain the retainer within the channel. The access port cap or plug can also have a flexible annular bead with a diameter greater than a diameter of the access port in order to provide a generally sealing interference fit. However, the diameter of the access port plug's annular bead may also be smaller than the distance between the lips thereby allowing the annular bead to pass therebetween. The access port cap may cover the access port of the lid when the retainer is in a first position within the channel. Conversely, the access port cap may be at least partially received within the channel when the retainer is in a second position within the channel.

Other and further objects of the invention, together with the features of novelty appurtenant thereto, will appear in the course of the following description.

DESCRIPTION OF THE SEVERAL VIEWS OF THE DRAWINGS

In the accompanying drawings, which forth a part of the specification and are to be read in conjunction therewith in which like reference numerals are used to indicate like or similar parts in the various views.

DETAILED DESCRIPTION OF THE INVENTION

Figure 1:
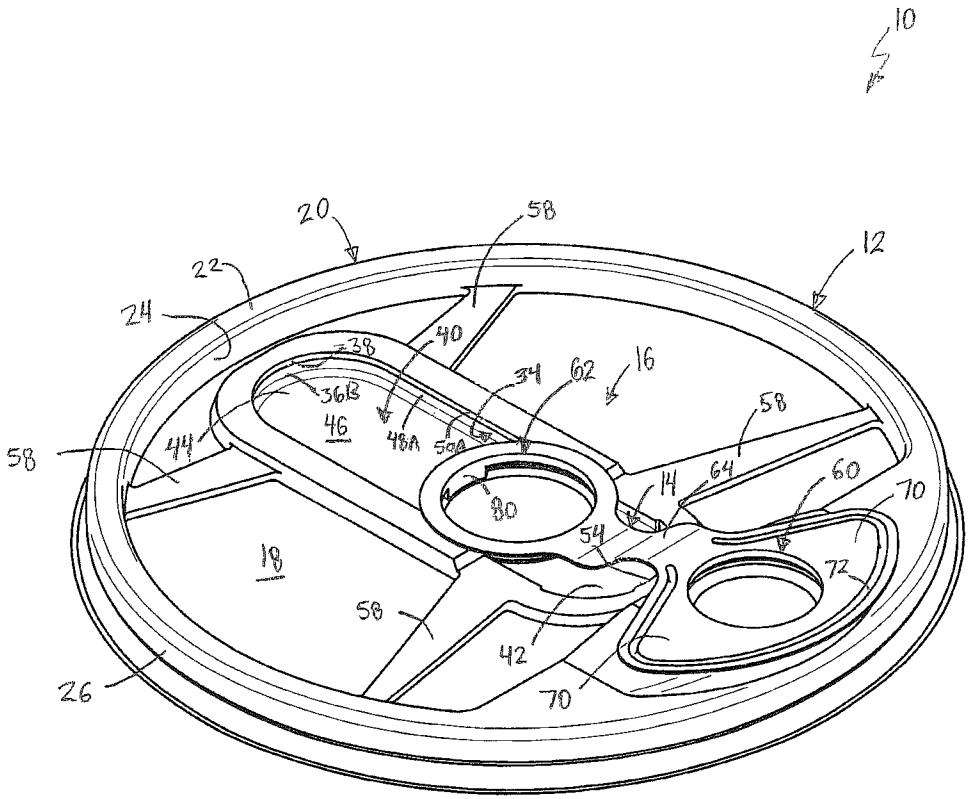
FIG. 1 is a top perspective view of a lid and closure member assembly illustrating the closure member in a closed position in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

Figure 2:
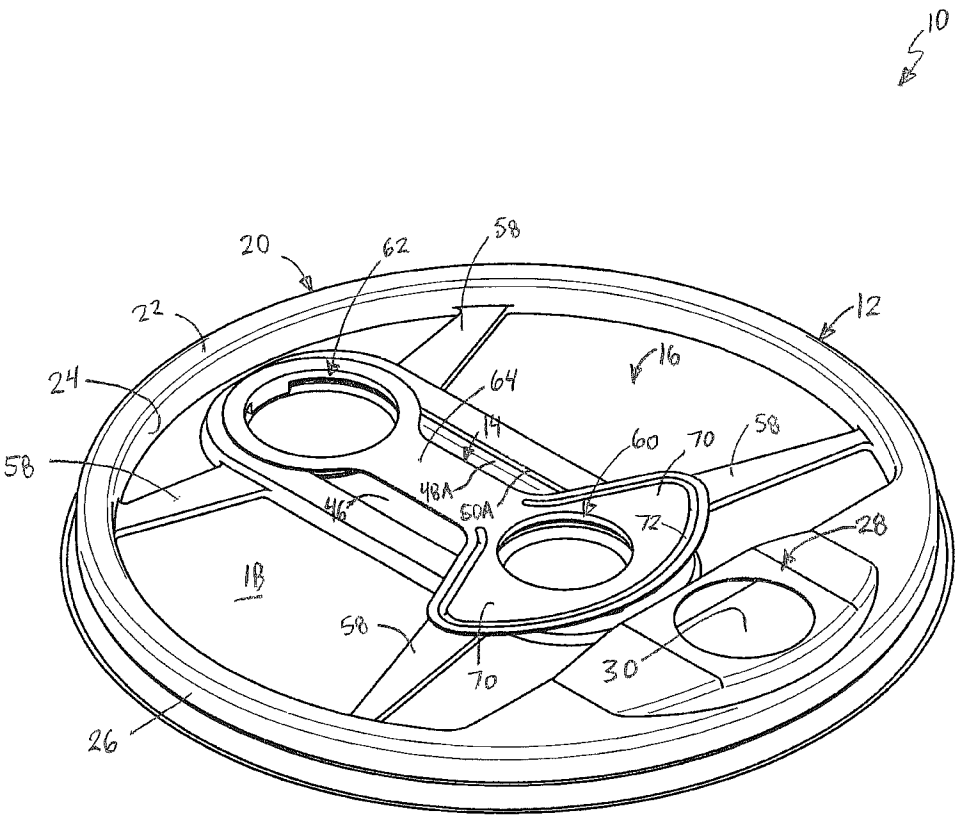
FIG. 2 is a top perspective view of a lid and closure member assembly illustrating the closure member in an open position in accordance with one embodiment of the present invention.

FIGS. 1 and 2 illustrate a lid and closure assembly 10 according to one embodiment of the present invention. As shown, the assembly 10 includes a lid 12 and a closure member 14 attached thereto. The lid 12 may be substantially circular in shape so as to fit onto the open end of a drinking cup or other round container having an open free end, a sidewall depending therefrom and a bottom. It will be appreciated that the lid 12 can be formed of a plastic or other polymeric material and may be formed from an extruded sheet or by a thermoforming or injection molding process. The lid 12 comprises a cover portion 16 and a rim portion 20 around a periphery of the cover portion 16. The cover portion 16 spans across the opening of a cup when the lid 12 is placed thereon and may include substantially flat recessed areas 18. The rim portion 20 may include a top wall 22 and inner and outer sidewalls 24 and 26 for engagement and securement to the top end of a cup. The outer sidewall 26 may include or be in the form of an outwardly-flared skirt. In other embodiments, the lid 12 is threaded and can be screwed onto the top of a container.

The cover portion 16 of the lid 12 includes a readily accessible drinking or access port 30 defined therein providing access to the contents within the container to which the lid 12 is attached. As shown in FIG. 2, the access port 30 may be defined in a raised pour spout 28, making it easier for a user to drink or pour through the lid 12. Stiffening ribs or webbing 58 spanning the cover portion 16 of the lid 12 may be provided for additional strength and rigidity.

In accordance with the present invention, the lid 12 and closure member 14 can be integrally connected. The lid 12 includes an elongated channel 40 defined therein for slidably receiving and retaining a portion of the closure member 14. The elongated channel 40 has first and second ends 42 and 44 with a center portion extending therebetween. As illustrated, the channel 40 may be generally racetrack-shaped and defined by two opposing generally parallel side walls 48A, 48B and to opposing curved, semicircular end walls 36A, 36B. The channel 40 has a bottom wall 46, which may include an aperture 56 defined therein that can function as a port to vent the container and/or function as a drain hole should any liquid become deposited in the channel 40.

Figure 5:
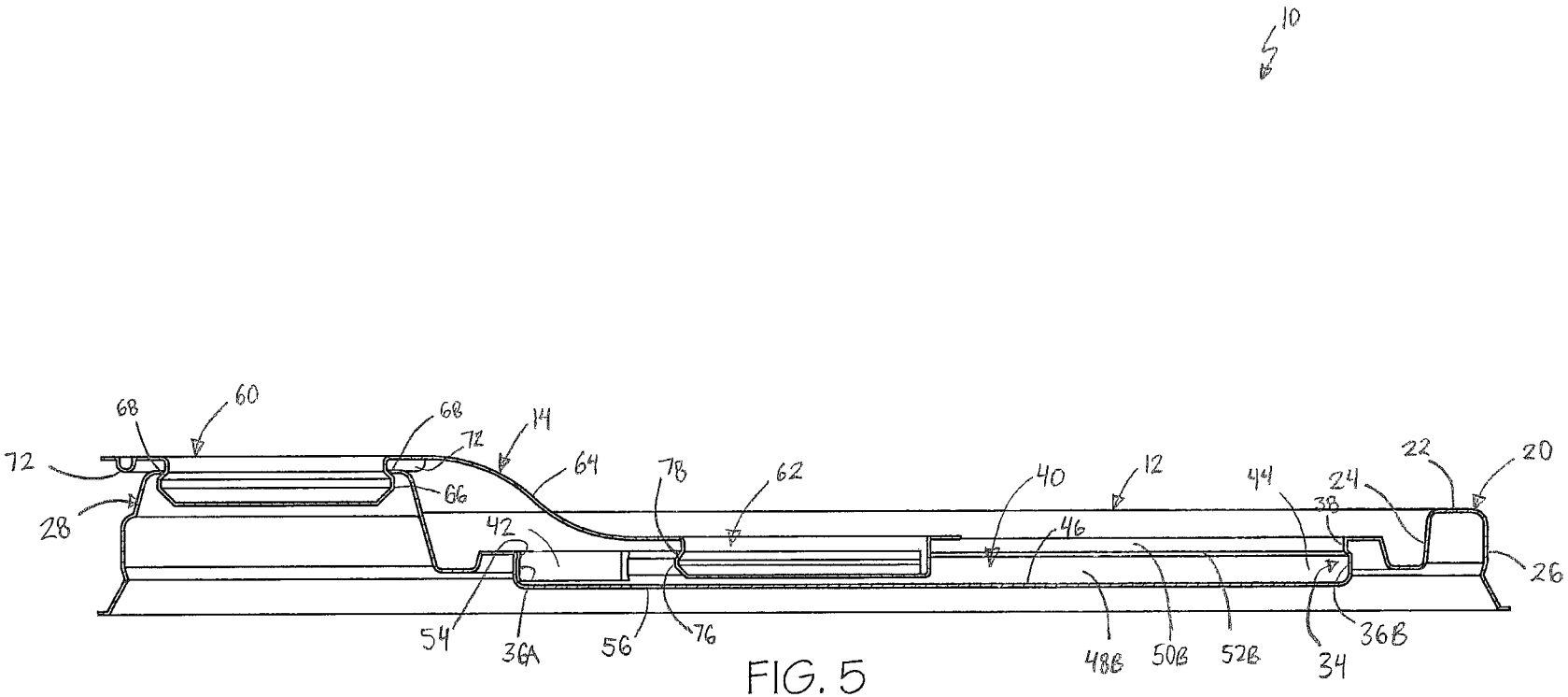
FIG. 5 is a cross-section view of the lid and closure member assembly shown in FIG. 4 taken generally along line 55 in the direction of the arrows.
Figure 6:
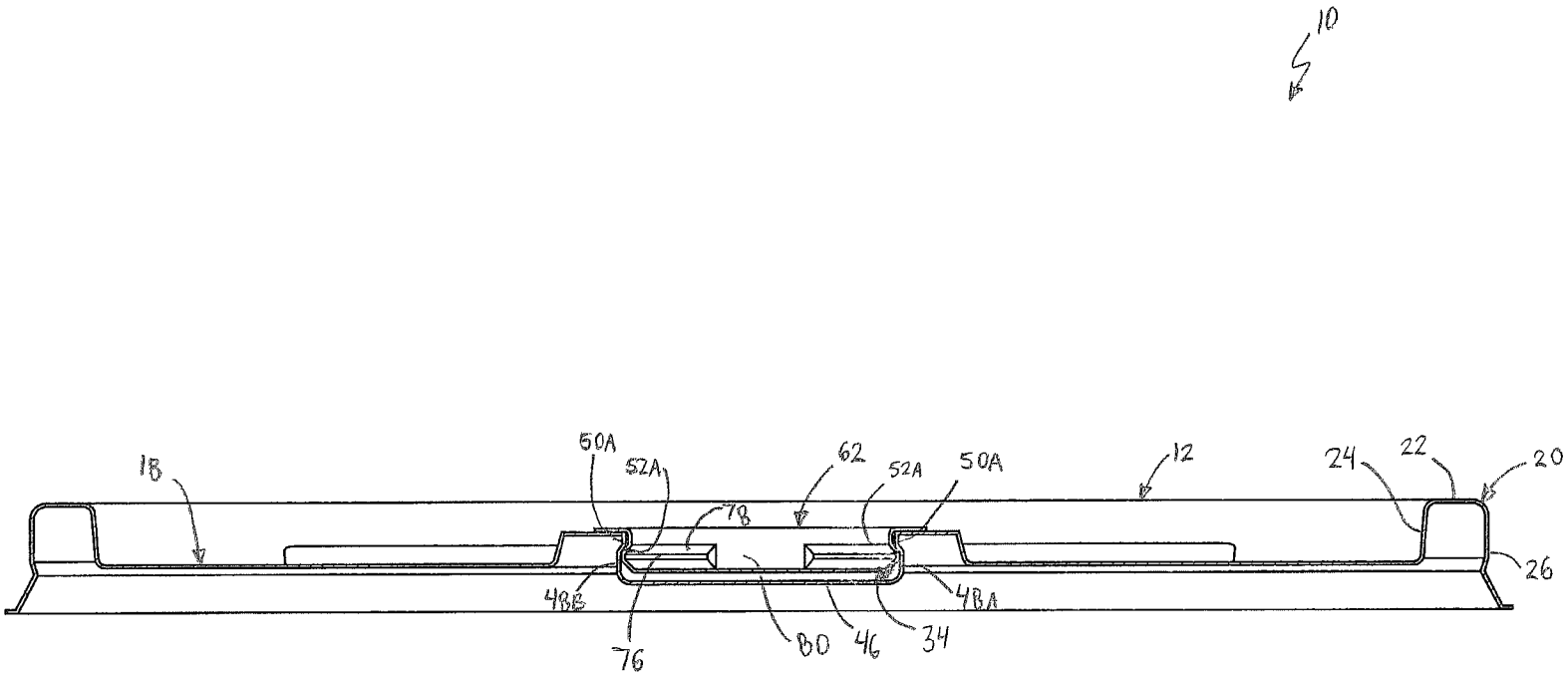
FIG. 6 is a cross-section view of the lid and closure member assembly shown in FIG. 4 taken generally along line 66 in the direction of the arrows.

As shown in the figures, a protrusion or lip 50A, 50B projects inwardly from one or both of the channel's 40 side walls 48A, 48B. As such, a groove or undercut 34 may be defined between each of the lips 50A, 50B and the channel's 40 bottom wall 46 for slidably retaining a portion of the closure member 14 within the channel 40. As illustrated in FIG. 6, the channel 40 can have a generally c-shaped cross-section formed by the bottom wall 46, the side walls 48A, 48B and the lips 50A, 50B. One or both of the curved, semicircular end walls 36A, 36B may also include a protrusion or lip 38 or a key 54 projecting inwardly into the channel 40, as best depicted in FIG. 5. Consequently, a groove or undercut 34 may be present in the areas of one or both of the end walls 36A, 36B. The lip 38 extending from the second end wall 36B may be continuously joined with the lips 50A, 50B extending from the side walls 48A, 48B. As will be discussed in further detail below, the first end wall 36A includes a key 54 allowing a portion of closure member 14 to be inserted into the channel 40 and then rotated to be slidably secured within the channel 40.

Turning attention now to the closure member 14, it will be understood that, in one embodiment, the closure member 14 comprises an access port cap 60, a retainer 62 and a tab or strap 64 extending therebetween. The closure member 14 may be constructed, at least partially, of a flexible polymeric or rubber material. The entire closure member 14 need not be made entirely of a uniform material. Rather, it will be appreciated that components may be formed of different materials and attached or bonded together during the manufacturing process.

Figure 3:
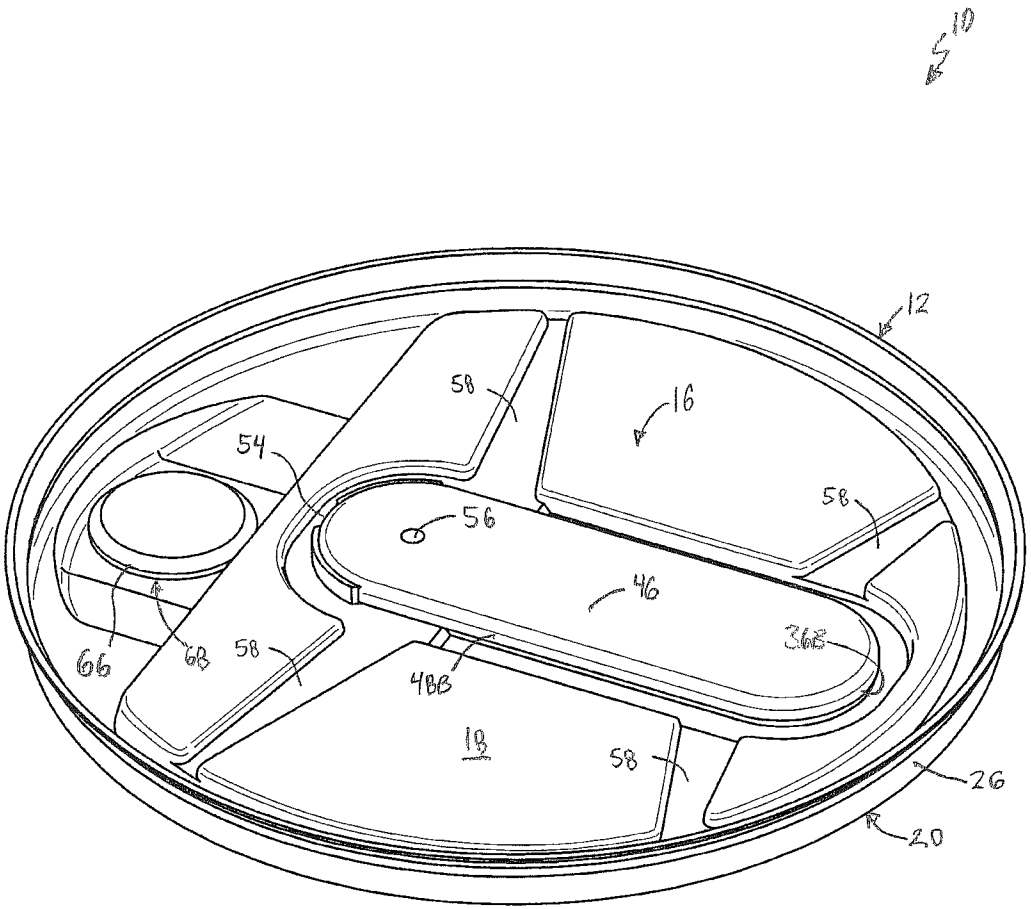
FIG. 3 is a bottom perspective view of a lid and closure member assembly illustrating the closure member in a closed position in accordance with one embodiment of the present invention.
Figure 4:
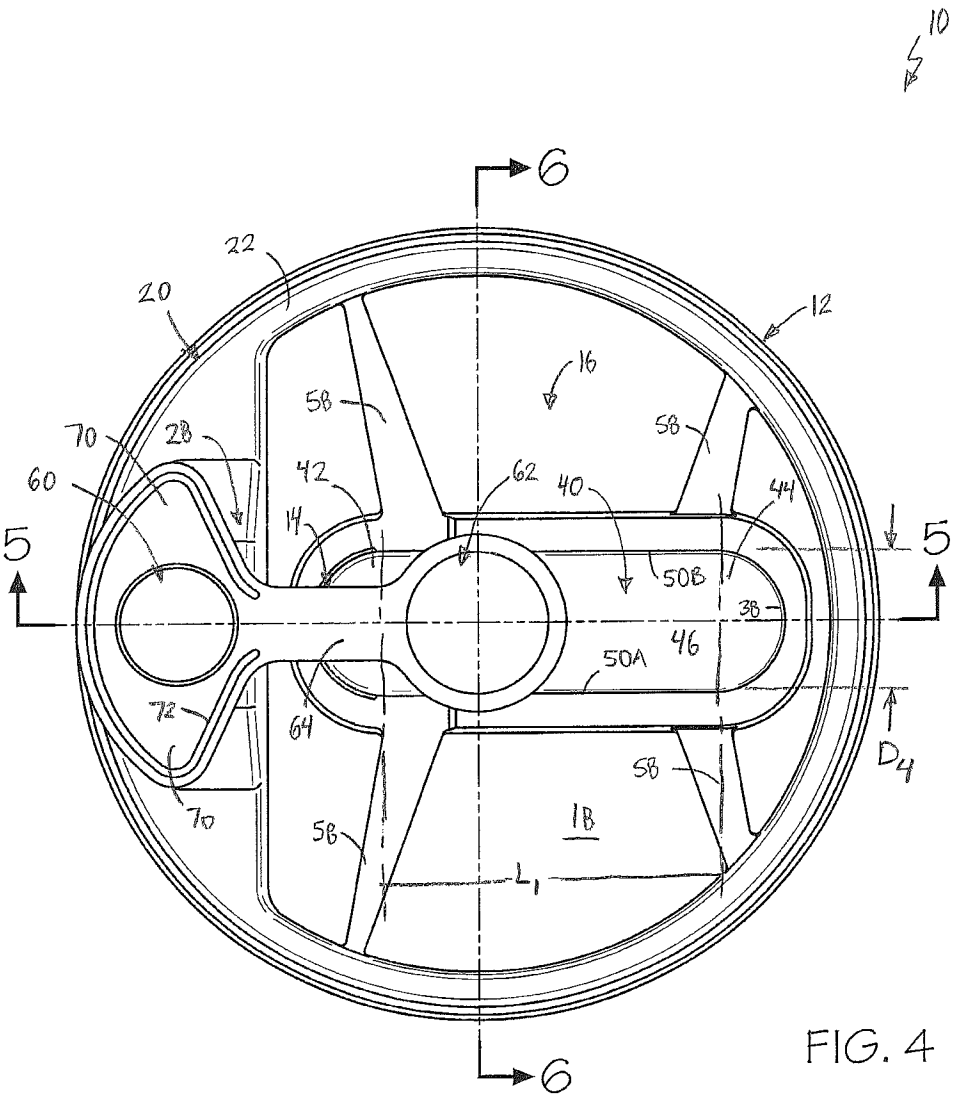
FIG. 4 is a top view of a lid and closure member assembly illustrating the closure member in a closed position in accordance with one embodiment of the present invention.
Figure 7:
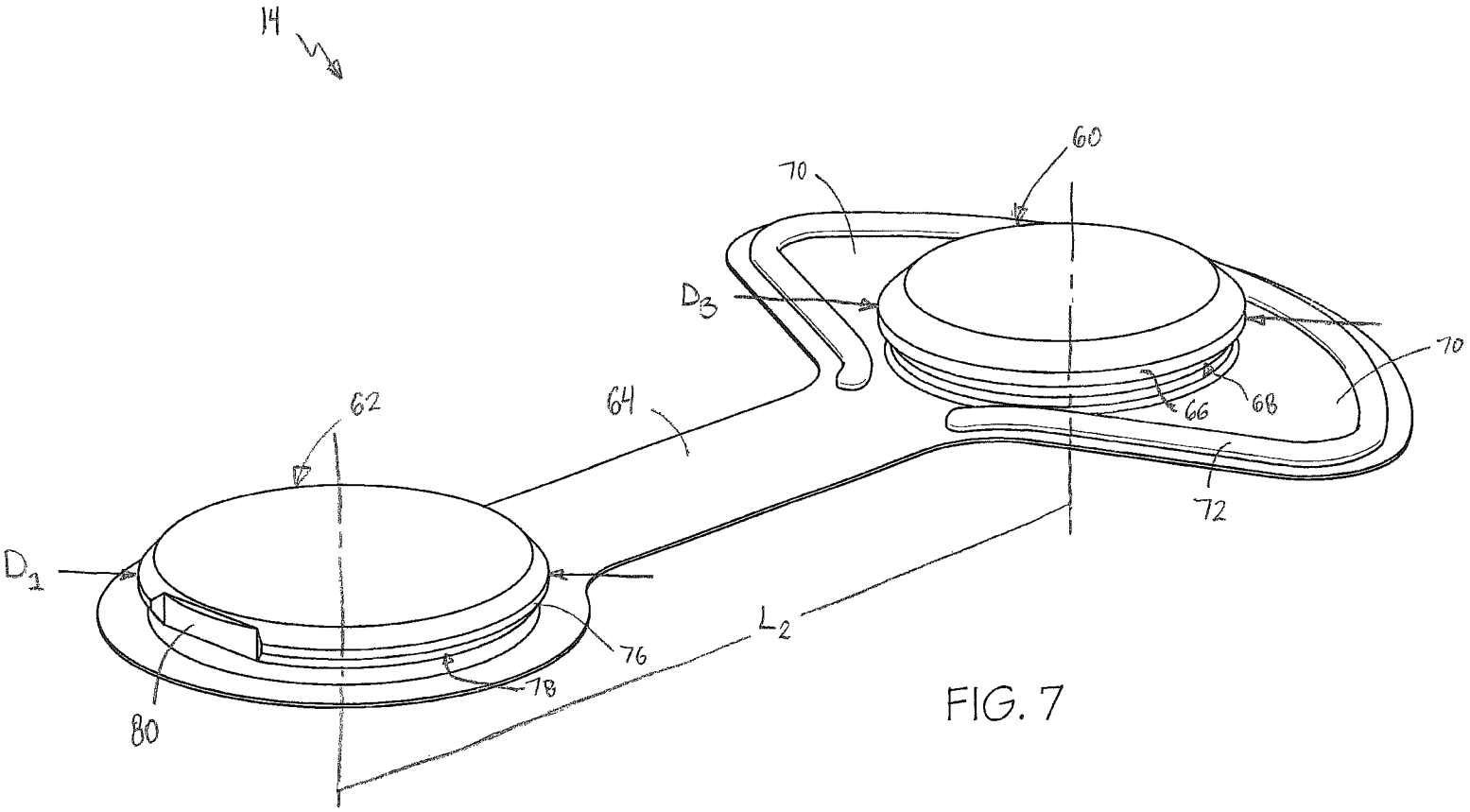
FIG. 7 is a bottom perspective view of a closure member in accordance with one embodiment of the present invention.
Figure 8A:
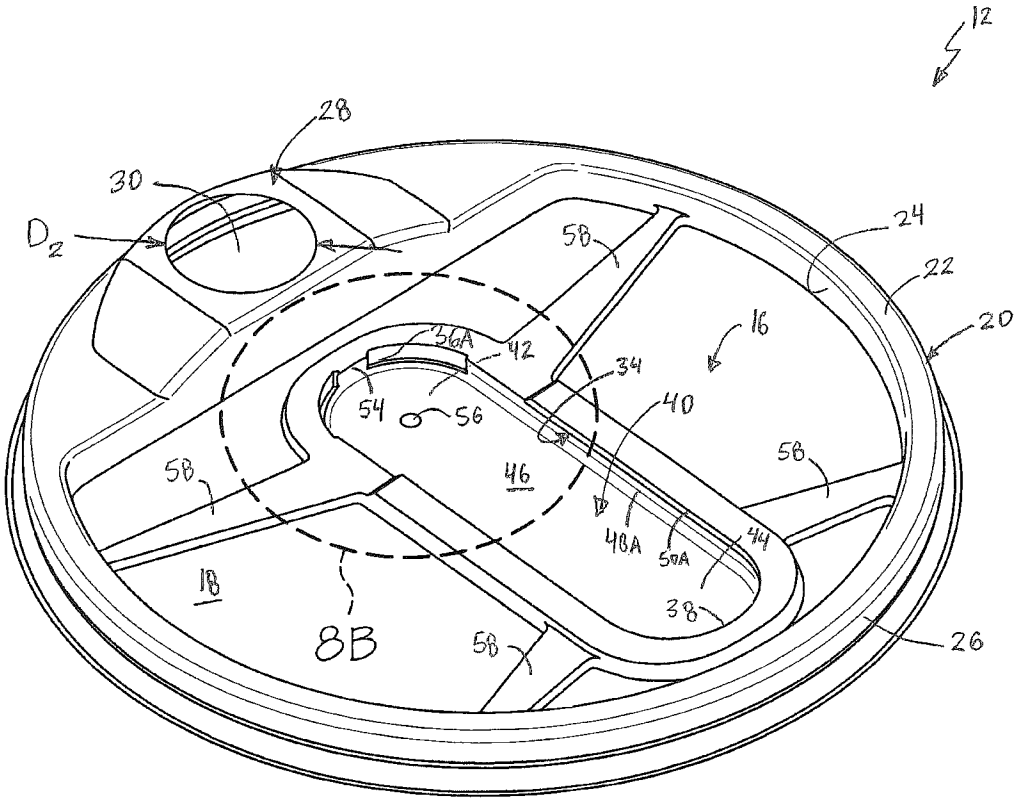
FIG. 8A is a top perspective view of a lid in accordance with one embodiment of the present invention.
Figure 8B:
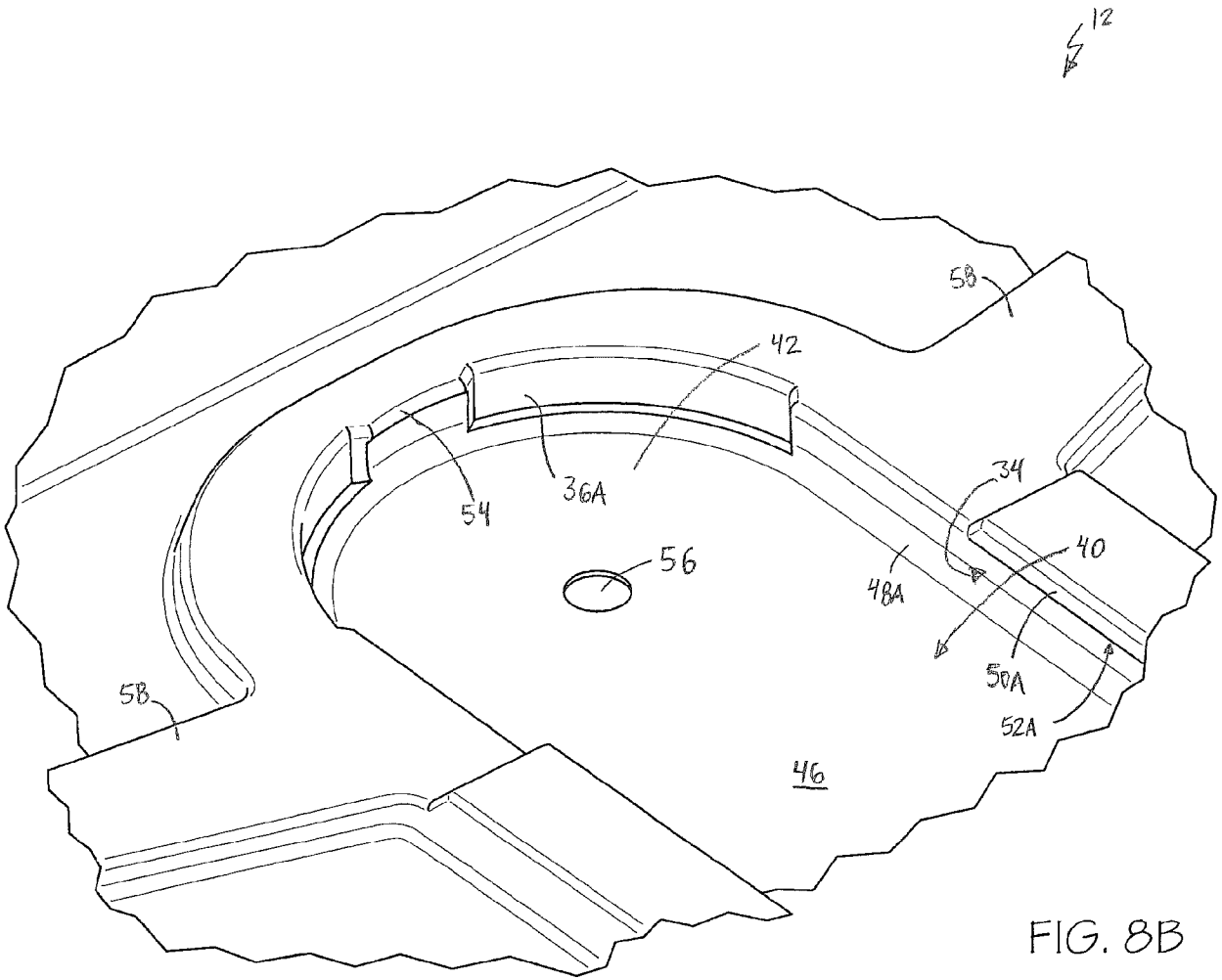
FIG. 8B is a partial top perspective view of a lid showing a portion of a channel in particular detail in accordance with one embodiment of the present invention.

The access cap 60 is adapted for selectively covering and/or generally sealing the access port 30 defined in the lid 12. In one embodiment, the access port cap 60 is in the form of a plug. As best shown in FIGS. 5 and 7, the access port cap or plug 60, which can be of a generally circular shape, may include a flexible annular bead 66. In one embodiment, the bead 66 has a diameter $D_1$ that is greater than the diameter $D_2$ of the access port 30 in order to provide a generally sealing interference fit, as demonstrated in FIGS. 3 and 5. The bead 66 can be formed of a flexible material thereby allowing the bead 66 to pass through the access port 30 when the plug 60 is inserted or removed from the access port 30. The bead 66 may be an outwardly-projecting rib formed into the side wall of the plug 60, as shown. In other embodiments, the bead 66 is attached to the outer surface of the side wall of the plug 66 and can be in the form of a rubber gasket, O-ring, washer or the like. The bead 66 includes an upper shoulder or surface 68 for engaging the periphery of the access port when the plug 60 is inserted therein. Alternative to having a bead 66, the access port cap or plug 60 may be in the form of a beveled stopper, may include threads and be adapted for screwing in or around the access port 30, or may include any other suitable means for attaching, fastening or securement to the access port 30 or a neck protruding therefrom. To aid in the insertion and removal of the plug 60 relative to the access port 30, the plug may have wings or flaps 70 extending therefrom providing a user with a surface to grip. The flaps 70 can include a ridge 72 or other projection or indention formed therein to assist the user in gripping the flap 70.

The retainer 62 may be a retainer plug including an at least partially annular retaining bead 76. As demonstrated, in the figures, the retainer 62 is slidably received within the channel 40. The bead 76 portion of the retainer 62 is positioned and maintained below the lips 50A, 50B of the channel 40 in the undercut 34. The diameter $D_3$ of the bead 62, or the distance $D_3$ which its projections span, as the case may be, is greater than the horizontal distance $D_4$ between the lips 50A, 50B so that the bead is retained below the lips 50A, 50B. The bead 76 includes an upper shoulder or surface 78 which may engage the under surfaces 52A, 52B of the lips 50A, 50B for slidably maintaining the retainer 62 below the lips 50A, 50B and in the undercut 34. Like bead 66, bead 76 may be an outwardly-projecting rib formed into the side wall of the retainer plug 62, as shown. In other embodiments, the bead 76 is a projection or attached object extending from the side wall of the plug retainer 62. It will be appreciated that the bead 76 need not be continuous and may include one or more breaks therein. In one embodiment, the bead 76 is in the form of multiple projections extending outwardly from the side wall of the retainer 62.

As depicted, the retainer 62 is generally circular in shape and is adapted for sliding, rotating and pivoting within the channel 40. As illustrated in FIG. 7, the retainer's bead 78 includes a notch 80 defined therein that correspondents to the key 54 extending inwardly from the first end wall 36A of the lid's channel 40. In order for the retainer 62 to be inserted into the channel 40, the closure member 14 is oriented such that the notch 80 is in line with the key 54 (i.e., oriented in a position that is 180° from that shown in FIG. 2). Once the retainer 62 is inserted into the first end 42 of the channel 40 in that fashion, the closure member is then rotated and the key 54 will engage the retainer's bead 76 thereby keeping the retainer 62 in the channel 40. As the retainer 62 is slid toward the second end 44 of the channel, the bead will be engaged by the lips 50A, 50B and if the retainer 62 is slid completely to the second end 44 of the channel 40, the bead will also be engaged by lip 38.

The closure member 14 is selectively movable between an open position, an example of which is demonstrated in FIG. 2, and a closed position, as shown in FIG. 1. When the closure member 14 is in the closed position, the retainer 62 is slid to the first end 42 of the channel 40 thereby allowing the access port plug 60 to be inserted into the access port 30. When the closure member 14 is in an open position, the retainer 62 can be slid to the second end 44 of the channel 40 thereby allowing the access port plug 60 to received in the channel 40 proximate its first end 42. It will be appreciated that the placement of the closure member 40 shown in FIG. 2 is only one example of the how the closure member 14 may be positioned when in the open position. As illustrated, both the retainer 62 and the access port plug 60 are at least partially placed in the channel 40 in a stored position. In this embodiment, the diameter $D_1$ of the access port plug's bead 66 is larger than the diameter $D_2$ of the access port 30, but smaller than the horizontal distance $D_4$ between the lips 50A, 50B. However, it will be appreciated that the diameter $D_1$ of the access port plug's bead 66 may be slightly greater than the horizontal distance $D_4$ between the lips 50A, 50B so that the plug 60 may temporarily be snapped into or interlocked with the channel 40. In such a case, the interlocking is preferably minimal thereby allowing the user to easily disengage the plug 60 from the channel 40 using only a desirable amount of force.

This placement of the closure member 14 shown in FIG. 2 ensures that the closure member 14 is, secured and will not interfere as the user drinks or pours from the container. In this embodiment, the channel 40 has a center-to-center length $L_1$ that is approximately equal to the center-to-center length $L_2$ of the closure member 14. However, it will be appreciated that the length $L_1$ of the channel 40 may be greater than or less than the length $L_2$ of the closure member 14. In an embodiment wherein the length $L_1$ of the channel 40 is less than the length $L_2$ of the closure member 14, the strap 64 of the closure member 14 may be buckled or bowed and can force the bead 66 of the access port plug 60 to be hooked under the key 54 extending from end wall 36A thereby assisting in the securement of the closure member 14 when it is in the open position.

It will finally be appreciated that the access port 30, channel 40 and closure member 14 need not be part of a lid 12, but may instead be part of the container.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A closure member for use with a container lid, said closure member comprising:

an access port plug for selectively covering an access port defined in said lid;

a retainer adapted for being slidably received within a channel defined in said lid; and a flexible strap extending between said access port plug and said retainer;

wherein said strap is configured for selectively moving said closure member between a first position and a second position;

wherein when said closure member is in said first position, said access port plug is adapted for covering said access port and said retainer is adapted for being received within said channel;

wherein when said closure member is in said second position, said access port plug is adapted for being removably retained within said channel and said retainer is adapted for being received within said channel.

2. The closure member of claim 1, wherein said retainer is a retainer plug including an annular retaining bead extending at least partially therearound.

3. The closure member of claim 2 further comprising a notch defined in said retaining bead.

4. The closure member of claim 1, wherein said retainer is generally circular in shape and is adapted for sliding and rotating within said channel.

5. The closure member of claim 1, wherein said access port plug includes a flexible annular bead having a diameter greater than a diameter of said access port in order to provide a generally sealing interference fit.

6. The closure member of claim 1, wherein said access port plug has a diameter slightly larger than a horizontal distance between a first channel lip and a second channel lip of said channel so that said access port plug is suitable for snapping past said channel lips when inserted into said channel.

7. The closure member of claim 6, wherein said access port plug interlocks below said channel lips when said access port plug is retained within said channel.

8. The closure member of claim 7, wherein said access port plug is positioned at least partially below said channel lips when said access port plug is retained within said channel.

9. The closure member of claim 8, wherein said access port plug is configured for being selectively removed from said channel after being retained within said channel.

10. A closure member for use with a container lid, said closure member comprising:

an access port plug for selectively covering an access port defined in said lid;

a retainer adapted for being slidably retained within a channel defined in said lid, said channel having first and second channel lips defining an opening therebetween; and a strap extending between said access port plug and said retainer;

wherein a diameter of said access port plug is approximately equal to a diameter of said retainer such that both said access port plug and said retainer are temporarily retainable within said channel.

11. The closure member of claim 10 further comprising:

an access port plug annular retaining bead formed around at least a portion of said access port plug; and a retainer annular retaining bead formed around at least a portion of said retainer.

12. The closure member of claim 11, wherein a diameter of said access port plug annular retaining bead is slightly larger than a horizontal distance between said first and second channel lips to enable said access port plug to be snapped into said channel by urging said access port plug annular retaining bead below said first and second channel lips.

13. The closure member of claim 12, wherein said access port plug is temporarily interlocked with said first and second channel lips.

14. The closure member of claim 13, wherein said diameter of said access port plug annular retaining bead is greater than a diameter of said access port in order to provide a generally sealing interference fit.

15. The closure member of claim 11, wherein a diameter of said access port plug annular retaining bead is slightly larger than a horizontal distance between said first and second channel lips to enable said access port plug to be snapped into and removed from said channel.

16. The closure member of claim 15, wherein said diameter of said access port plug annular retaining bead is greater than a diameter of said access port in order to provide a generally sealing interference fit.

17. The closure member of claim 10, wherein said retainer is generally circular in shape and adapted for sliding and rotating within said channel.

* * * * *